US006393961B1

(12) United States Patent
Ockenfuss

(10) Patent No.: US 6,393,961 B1
(45) Date of Patent: May 28, 2002

(54) STRAIGHT-PULL BREECHBLOCK WITH ROTATING BOSS LOCKING MECHANISM FOR REPEATING WEAPONS

(75) Inventor: Ulrich Ockenfuss, Baiersbronn (DE)

(73) Assignee: Sommer + Ockenfuss GmbH, Baiersbronn (DE)

( * ) Notice: Subject to any disclaimer, the term of this patent is extended or adjusted under 35 U.S.C. 154(b) by 0 days.

(21) Appl. No.: 09/591,214

(22) Filed: Jun. 9, 2000

(30) Foreign Application Priority Data

Feb. 29, 2000 (DE) ..... 100 09 616

(51) Int. Cl.[7] ..... F41A 3/20

(52) U.S. Cl. ..... 89/172; 89/174; 89/185; 89/188; 42/16

(58) Field of Search ..... 89/172, 173, 174, 89/185, 187.01, 188; 42/16

(56) References Cited

U.S. PATENT DOCUMENTS

| | | | | | |
|---|---|---|---|---|---|
| 991,962 A | * | 5/1911 | Eastwick | ..... | 89/153 |
| 2,941,449 A | * | 6/1960 | Reed | ..... | 89/185 |
| 3,653,140 A | | 4/1972 | Alday | ..... | 42/16 |

FOREIGN PATENT DOCUMENTS

| | | | | | |
|---|---|---|---|---|---|
| DE | 293778 | * | 8/1916 | ..... | 89/172 |
| DE | 708197 | * | 7/1941 | ..... | 89/185 |
| DE | 713126 | * | 11/1941 | ..... | 89/185 |
| GB | 252487 | * | 6/1926 | ..... | 89/172 |
| GB | 1221016 | * | 2/1971 | ..... | 89/185 |

* cited by examiner

*Primary Examiner*—Stephen M. Johnson
(74) *Attorney, Agent, or Firm*—Darby & Darby

(57) ABSTRACT

Straight-pull breechblock (20) with rotating-boss locking mechanism for repeating weapons, having a breechblock head (27) which is guided in a longitudinally and rotationally movable manner in a breechblock housing (22) and has locking bosses (42, 43), and having a breechblock sleeve (24) which carries a bolt handle (28) and in which is mounted a firing pin (23) which is acted upon by a firing spring (53), for the movement of the breechblock head (27) in the longitudinal direction, while the rotational movement thereof is forced by way of the pretension of the firing spring (53) which acts on the firing pin (23), wherein by way of a forcibly controlled spring-mounted stopping lever (58) associated with the breechblock sleeve (24), relative movements between the breechblock head (27) and the breechblock sleeve (24) can be prevented until the breechblock head (27) has gone into the region of the locking chamber (44) of the breechblock housing (22).

8 Claims, 3 Drawing Sheets

STRAIGHT-PULL BREECHBLOCK WITH ROTATING BOSS LOCKING MECHANISM FOR REPEATING WEAPONS

BACKGROUND OF THE INVENTION

The present invention relates to a straight-pull breechblock with rotating-boss locking mechanism for repeating weapons, having a breechblock sleeve which is guided in a breechblock housing and carries a bolt handle for the manual to-and-fro motion and in which, by means of a shaft, a breechblock head which bears locking bosses is mounted in a forcibly guided, rotatable manner, and which breechblock sleeve comprises a firing pin which is acted upon by a firing spring, which further serves to generate an angular momentum in order to rotate the breechblock head in the locking position into the locking chamber corresponding to the locking bosses.

For this purpose, the breechblock head, which is continuously acted upon by the firing spring, is guided in spiral grooves and, as a result of the pretension of the firing spring, when the front region of the breechblock housing is reached, is transferred into the locking position by means of a clockwise rotation; compare Steyr repeating weapon model 1895.

However, the consequence of this continuous loading of the breechblock head is that over the entire area of the guideways of the breechblock housing, the right-hand locking boss rests resiliently on the latter, which makes the forwards and backwards motion of the straight-pull breechblock considerably more difficult, quite apart from the wear which occurs in this connection.

SUMMARY OF THE INVENTION

The object of the invention is to remedy this by means of a new design of a straight-pull breechblock of the type mentioned in the introduction, which is easier to operate than before without the above-mentioned wear.

Starting from the known straight-pull breechblock, this object is achieved in accordance with the invention as a result of the fact that associated with the breechblock sleeve are forcibly controlled stopping means which block the angular momentum which effects the locking of the breechblock.

According to a further feature of the invention, there is provided as the stopping means which suppress relative movements between the breechblock sleeve and the breechblock head a stopping lever which is acted upon by a spring in the stopping direction and is mounted rotatably on the breechblock sleeve, the one lever arm of which stopping lever has a locking projection corresponding with a locking groove in the shaft of the breechblock head and the other lever arm of which has a control ramp which cooperates with a contact edge of the breechblock bridge, all this in such an arrangement that when the breechblock sleeve and breechblock head are moved into the locking position, the stopping lever, upon reaching the locking position, is, by way of the control ramp, against the action of the spring, brought out of engagement with the locking groove, while in the case of movement out of the locking position, the locking projection of the stopping lever which then becomes free engages resiliently again in the locking groove of the breechblock head.

The relative movements between the breechblock sleeve, which carries the bolt handle, and the breechblock head, are, in accordance with the invention, forced by two spiral grooves arranged opposite each other in the shaft of the breechblock head, with which spiral grooves are associated corresponding stationary groove blocks in the breechblock sleeve.

Moreover, the breechblock sleeve has opposing guide bosses which cooperate with guide surfaces of the breechblock housing, one of which guide bosses is used as a bearing for the stopping lever.

Advantageously, the shaft of the breechblock head is provided, at the rear end, with a firing-spring collar screw, which serves as an abutment for the firing spring and by way of which the firing spring is operatively connected to the breechblock head.

Further features of the invention emerge from the subclaims.

As a result of the development in accordance with the invention of the straight-pull breechblock, the considerable angular momentum on the breechblock head is blocked until the locking bosses of the said breechblock head have gone into the region of the locking chamber. In this way, when the breechblock is moved manually forwards and backwards by means of the bolt handle, the resilient resting of the right-hand locking boss of the breechblock head on the respectively associated guideway in the breechblock housing is dispensed with, something which substantially facilitates operation. The mass of the breechblock sleeve that is to be moved by way of the bolt handle is increased only slightly by the stopping lever, and therefore has a negligible effect on the operating convenience. The wear on the breechblock portions is likewise reduced, which has a favourable effect on the reliable locking of the breechblock head.

Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims.

BRIEF DESCRIPTION OF THE DRAWINGS

In the following, the invention is described with the aid of a straight-pull breechblock for a repeating weapon that is represented more or less diagrammatically in the drawing, in which.

DETAILED DESCRIPTION OF THE PRESENTLY PREFERRED EMBODIMENTS

Figure 1A:
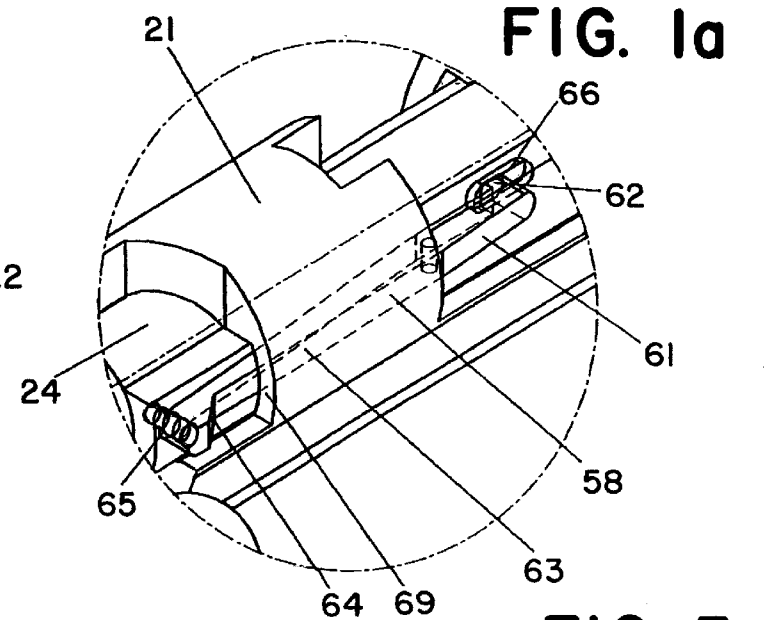
FIG. 1*a* shows an enlarged detail of FIG. 1.

In order to give an overview, basically only the breechblock sleeve (24) and the portions associated therewith that are constructed in accordance with the invention are shown in the figures of the drawing, while the associated repeating weapon with the barrel, the cartridge chamber and the trigger are left out.

A straight-pull breechblock, denoted overall with the reference numeral 20, comprises a breechblock housing 22, which has a breechblock bridge 21 and a breechblock sleeve 24 comprising a firing pin 23, in which breechblock sleeve, by way of a shaft 26, a breechblock head 27 is mounted in a forcibly guided, rotatable manner. The breechblock sleeve 24 carries a bolt handle 28 for the manual to-and-fro motion in the breechblock housing 22.

Figure 3:
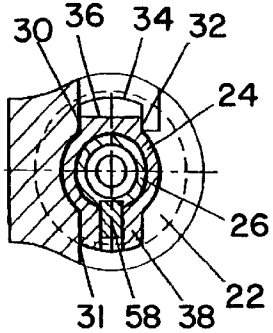
FIG. 3 shows a section in accordance with line A—A in FIG. 2.
Figure 4A:
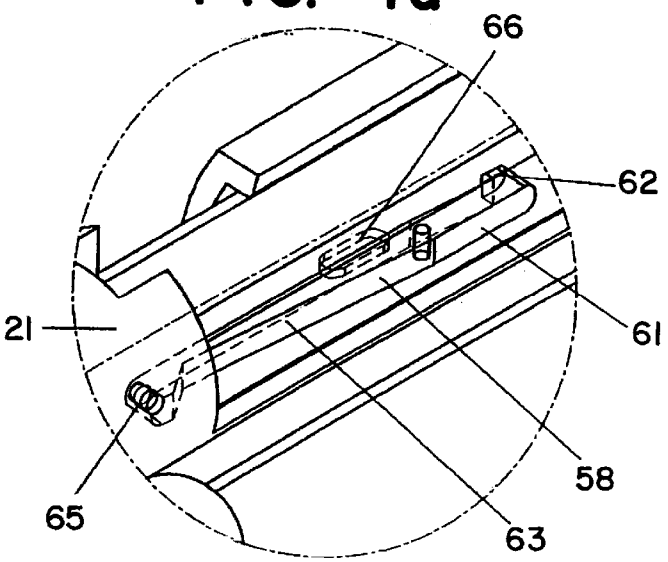
FIG. 4*a* shows an enlarged detail of FIG. 3 [sic]
Figure 4:
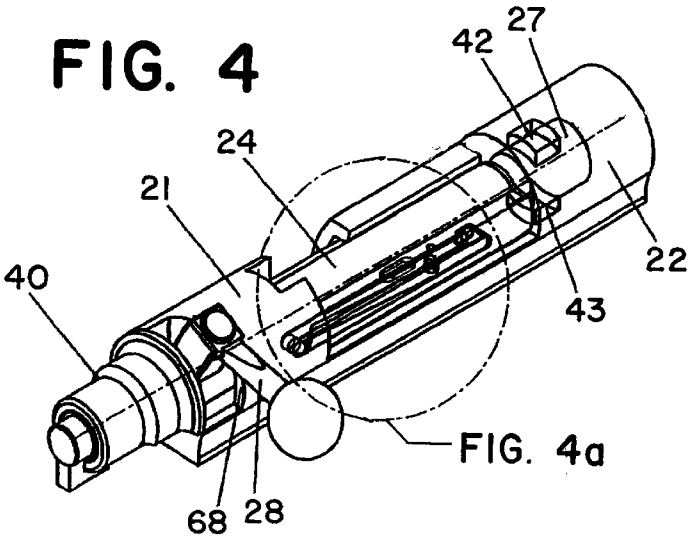
FIG. 4 shows the straight-pull breechblock according to FIG. 1 in the locked position of the breechblock head.
Figure 6:
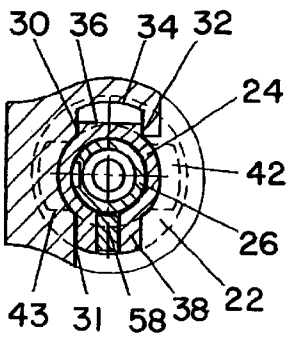
FIG. 6 shows a section in accordance with the line B—B in FIG. 5.

Guide surfaces 30,31 and 32 provided on the inside wall of the breechblock housing 22, of which the opposing guide surfaces 30 and 32 form a guide groove 34, serve to mount the breechblock sleeve 24 in the breechblock housing 22; see FIG. 3.

A left-hand guide boss 36 of the breechblock sleeve 24 engages in the above-mentioned guide groove 34, and a larger opposing right-hand guide boss 38 thereof rests on the above-mentioned guide surface 31.

Figure 1:
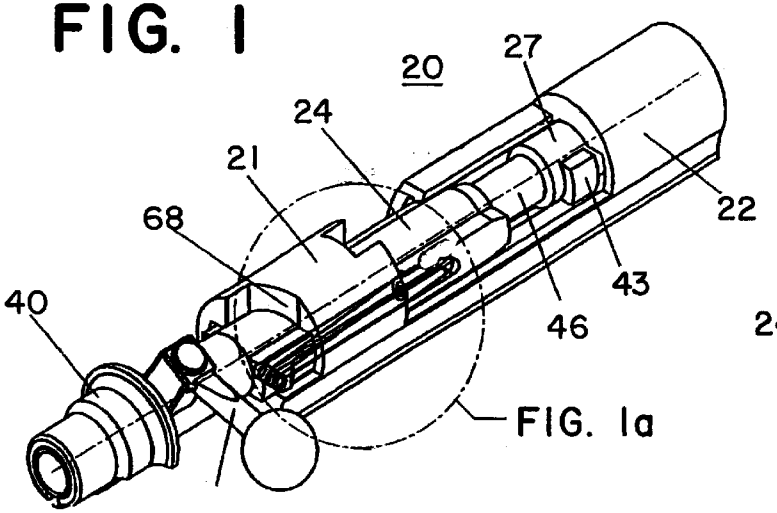
FIG. 1 shows the fundamental portions of a straight-pull breechblock in accordance with the invention in the unlocked position of its breechblock head, in perspective view.
Figure 2:
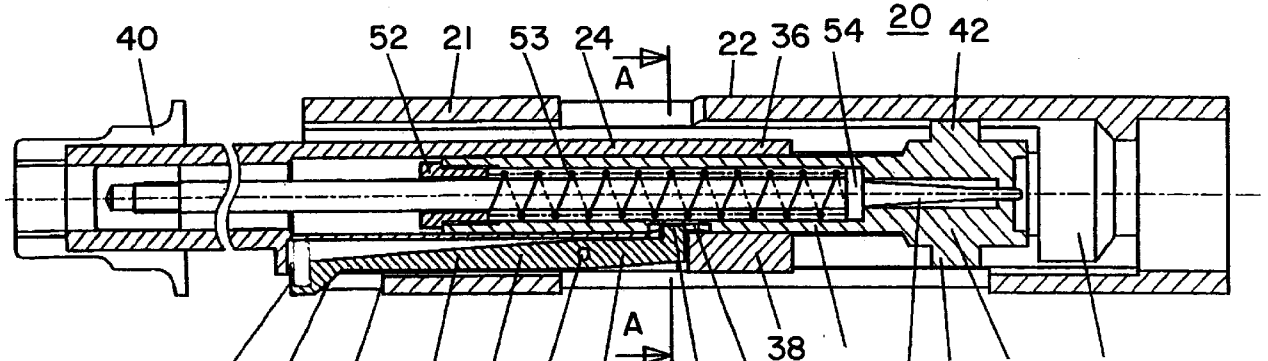
FIG. 2 shows a longitudinal section through the straight-pull breechblock according to FIG. 1.
Figure 7:
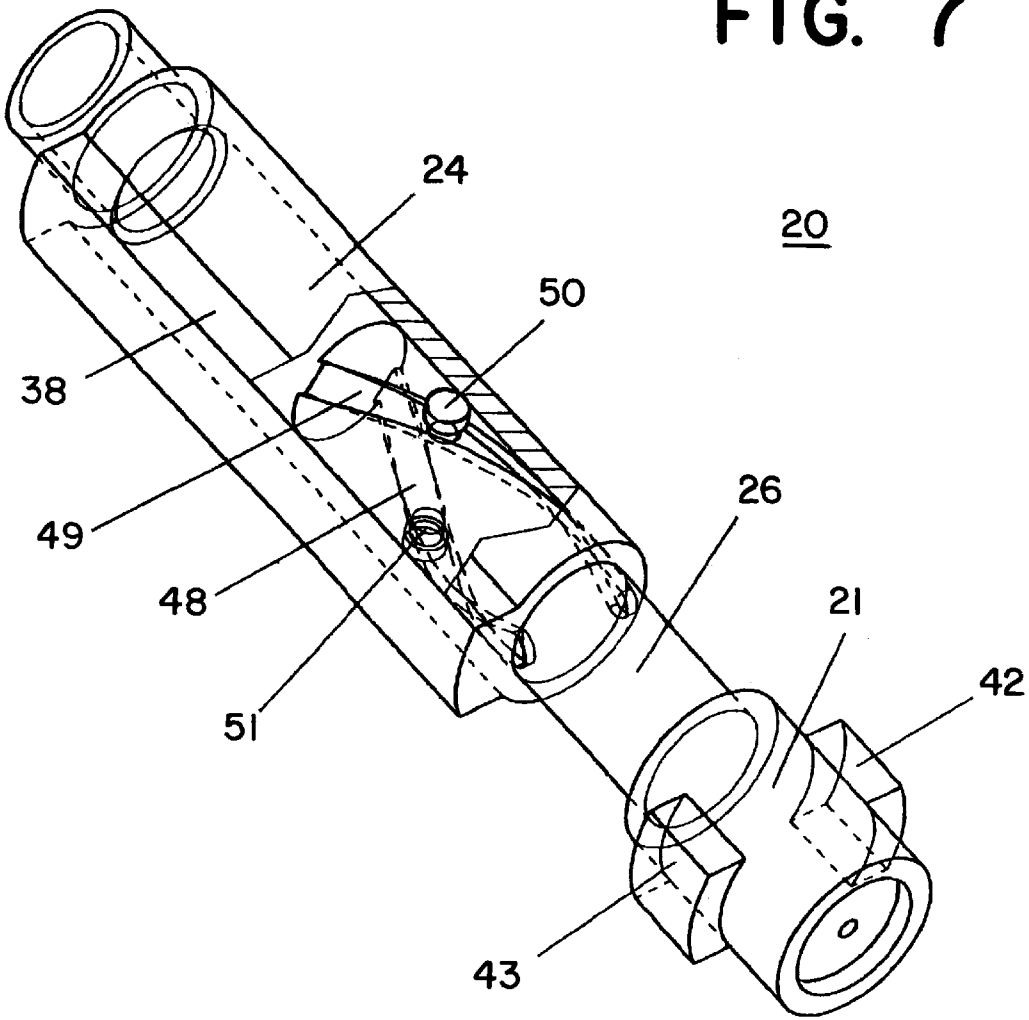
FIG. 7 shows an enlarged representation of a detail of the rotatable bearing between the breechblock sleeve and the breechblock head of the straight-pull breechblock according to FIG. 1

Associated with the end of the breechblock sleeve 24 that is free in FIG. 2 are a clasp nut 40 with its functional parts (not shown in detail)—securing wing and suchlike—and also the above-mentioned bolt handle 28. The breechblock head 27 carries two opposing locking bosses 20 42 and 43. By way of an integral shaft 26, the breechblock head 27 is mounted in a forcibly guided, rotatable manner in the breechblock sleeve 24, as FIG. 7 shows. For this purpose, there are provided in the breechblock sleeve 24 two opposing spiral grooves 48 and 49, in which corresponding groove blocks 50, 51 arranged permanently in the breechblock sleeve 24 engage. A firing spring 53 clamped between a firing-spring collar screw 52, which sits at the rear end of the shaft 26, and a collar 54 of the firing pin 23 comprises in a known manner the firing pin 23 and thus acts on the breechblock head 27, and therefore has the tendency to impose on the breechblock head 27, along the spiral grooves 48 and 49, an angular momentum which is directed to the right with respect to FIG. 1.

In order to allow this angular momentum to become effective only if the locking bosses 42 and 43 of the breechblock head 27 are in the region of the locking chamber 44, i.e. in the locking position, there is provided a stopping lever 58, which is mounted on the right-hand guide boss 38 of the breechblock sleeve 24 in a manner such that it can pivot about the point of rotation 59 and comprises a short lever arm 61 having a locking projection 62 and also a long lever arm 63 having a control ramp 64, and in the region of the control ramp 64 is acted upon by a spring 65 in the anti-clockwise direction, which spring is located in blind-end bores on the stopping lever 58 and on the wall of the breechblock sleeve 24; see FIG. 2. Associated with the locking projection 62 is a locking groove 66, which is located in the wall of the breechblock head 27. In the switch position "breechblock open" shown in FIG. 2, the locking projection 62 engages in the locking groove 66 and thus prevents relative movements between the breechblock head 27 and the breechblock sleeve 24 which supports it. The rear end of the long lever arm 63 having the control ramp 64 is located behind the breechblock bridge 21, the contact edge 69 of which projects into the path of motion of the control ramp 64.

Figure 5:
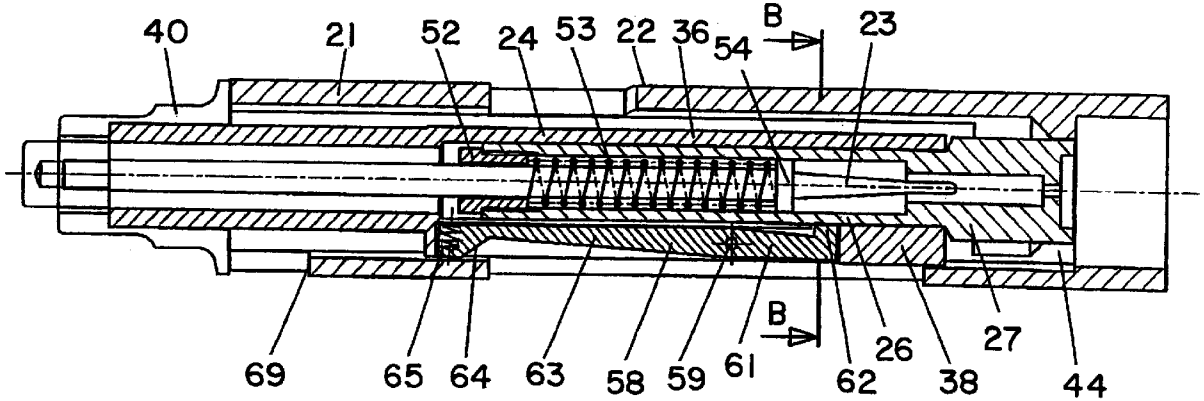
FIG. 5 shows a longitudinal section through the breechblock according to FIG. 1 in the locked position.

If the above-described straight-pull breechblock 20 is moved forwards with respect to the weapon axis by means of the bolt handle 28, then as a result of the running-up of the control ramp 64 on to the contact edge 69 of the breechblock bridge 21, in the clockwise direction against the force of the spring 65, the stopping lever 58 mounted at the point of rotation 59 frees the breechblock head 27 as a result of the disengagement of the locking projection 62 out of the locking groove 66, as can be seen from FIG. 5. As a result of this, by way of the angular momentum generated by the firing spring 53, the locking bosses 42 and 43 of the breechblock head 27 in the corresponding locking chamber 44 can rotate to the right with a rotation of 90° and thus lock the breechblock head 27, as shown in FIG. 5. If the breechblock is opened and the breechblock sleeve 24 moved to the rear with respect to the weapon axis by way of the bolt handle 28, i.e. opened, the control ramp 64 of the stopping lever 58 is pulled through underneath the breechblock bridge 21 and, as soon as it has passed this, is released. By way of the spring 65, which is mounted in a blind-end bore in the rear region of the long lever arm 63 of the stopping lever 58, the said stopping lever is, immediately after the release, moved about the point of rotation 59 in the anti-clockwise direction until the locking projection 62 again engages in the locking groove 66 and thus fixes the breechblock head 27 with respect to the breechblock sleeve 24. Any relative movements between the breechblock head 27 and the breechblock sleeve 24 are thus blocked again, and the straight-pull breechblock 20 can be slid easily to and fro.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. A straight-pull breechblock with rotating-boss locking mechanism for a repeating weapon, having a breechblock sleeve which is guided in a breechblock housing and carries a bolt handle for the manual to-and-fro motion and in which, by means of a shaft, a breechblock head which bears locking bosses is mounted in a forcibly guided, rotatable manner, and which breechblock further comprises a firing pin which is acted on by a firing spring, which further serves to generate an angular momentum in order to rotate the breechblock head in a locking position into a locking chamber corresponding to the locking bosses, associated with the breechblock sleeve (24) are forcibly controlled stopping means which block the angular momentum which effects the locking, and a stopping lever (58) provided as the stopping means which suppress relative movements between the breechblock sleeve (24) and the breechblock head (27), the stopping lever (58) is acted upon by a spring (65) in a stopping direction and is mounted rotatably on the breechblock sleeve (24), one lever arm (61) of which the stopping lever has a locking projection (62) corresponding with a locking groove (66) in the shaft (26) of the breechblock (27) and another lever arm (63) of which has a control ramp (64) which cooperates with a contact edge (69) of a breechblock bridge (21), all this in such an arrangement that when the breechblock sleeve (24) and breechblock head (27) are moved into the locking position, the stopping lever (58), upon reaching the locking position, is, by way of the control ramp (64), against the action of the spring (65), brought out of engagement with the locking groove (66), while in the case of movement out of the locking position, the locking projection (62) of the stopping lever (58) becomes free of the locking groove (66) of the breechblock head (27).

2. The straight-pull breechblock according to claim 1, wherein there are provided in the shaft (26) of the breechblock head (27) two opposing spiral grooves (48, 49) with which corresponding stationary groove blocks (50, 51) of the breechblock sleeve (24) are associated.

3. The straight-pull breechblock according to claim 2, wherein the breechblock sleeve (24) has opposing guide bosses (36, 38) which cooperate with guide surfaces (30, 31, 32) of the breechblock housing (22), one of which guide bosses (38) is used as a bearing for the stopping lever (58).

4. The straight-pull breechblock according to claim 3, wherein there is associated with the firing spring (53) which acts on the firing pin (23), a firing-spring collar screw (52) which sits on the shaft (26) and serves as an abutment and by way of which the firing spring (53) acts on the breechblock head (27) for the purpose of generating the angular momentum.

5. A straight-pull breechblock with a rotating-boss locking mechanism for a repeating weapon, comprising a breechblock housing;

a breechblock head;

a breechblock sleeve guided in the breechblock housing and engaging a bolt handle for manual operation of the breech block sleeve;

a shaft to which a breechblock head is mounted in a forcibly guided, rotatable manner;

at least two locking bosses are arranged on the breechblock head;

the breechblock sleeve comprises a firing pin which is acted on by a firing spring, and which further serves to generate an angular momentum for rotating the breechblock head in a locking position into a locking chamber corresponding to the locking bosses, wherein there are associated with the breechblock sleeve (24) forcibly controlled stopping means which block the angular momentum which effects the locking;

a stopping lever (58) provided as the stopping means for suppressing relative movements between the breechblock sleeve (24) and the breechblock head (27), the stopping lever (58) is acted upon by a spring (65) in a stopping direction and is mounted rotatably on the breechblock sleeve (24);

a first lever arm (61) of which the stopping lever has a locking projection (62) corresponding with a locking groove (66) in the shaft (26) of the breechblock (27) and a second lever arm (63) which has a control ramp (64) which cooperates with a contact edge (69) of a breechblock bridge (21); and upon the breechblock sleeve (24) and breechblock head (27) being moved into the locking position, the stopping lever (58), upon reaching the locking position, is, by way of the control ramp (64), against the action of the spring (65), brought out of engagement with the locking groove (66), while when moving out of the locking position, the locking projection (62) of the stopping lever (58) becomes free of the locking groove (66) of the breechblock head (27).

6. The straight-pull breechblock according to claim 5, wherein there are provided in the shaft (26) of the breechblock head (27) two opposing spiral grooves (48, 49) which correspond to stationary groove blocks (50, 51) of the breechblock sleeve (24).

7. The straight-pull breechblock according to claim 5, wherein the breechblock sleeve (24) has opposing guide bosses (36, 38) which cooperate with guide surfaces (30, 31, 32) of the breechblock housing (22), one of which guide bosses (38) is used as a bearing for the stopping lever (58).

8. A straight-pull breechblock according to claim 5, wherein there is a firing-spring collar screw (52) associated with the firing spring (53) which acts on the firing pin (23), the firing-spring collar screw (52) sits on the shaft (26) and serves as an abutment and by way of which the firing spring (53) acts on the breechblock head (27) for the purpose of generating the angular momentum.

* * * * *